US007120953B2

(12) United States Patent
Ferber et al.

(10) Patent No.: US 7,120,953 B2
(45) Date of Patent: Oct. 17, 2006

(54) PILLOW

(75) Inventors: Roman S. Ferber, West Bloomfield, MI (US); Sun Yu, Rochester Hills, MI (US); Russell T. Brzezinski, Berkley, MI (US); Barbara A. Westfield, Waterford, MI (US)

(73) Assignee: FKA Distributing Co., Commerce Township, MI (US)

( * ) Notice: Subject to any disclaimer, the term of this patent is extended or adjusted under 35 U.S.C. 154(b) by 0 days.

(21) Appl. No.: 11/146,794

(22) Filed: Jun. 7, 2005

(65) Prior Publication Data

US 2006/0123547 A1 Jun. 15, 2006

Related U.S. Application Data

(63) Continuation-in-part of application No. 29/219,200, filed on Dec. 14, 2004, now Pat. No. Des. 523,678.

(51) Int. Cl.
*A47G 9/10* (2006.01)

(52) U.S. Cl. ..... 5/636; 5/645; 5/490

(58) Field of Classification Search ..... 5/636–645, 5/490

See application file for complete search history.

(56) References Cited

U.S. PATENT DOCUMENTS

| | | | | | |
|---|---|---|---|---|---|
| 1,385,355 | A | | 7/1921 | Banks | |
| 2,577,595 | A | * | 12/1951 | Tobias | 5/632 |
| 3,849,810 | A | * | 11/1974 | Degen | 5/640 |
| 4,393,530 | A | | 7/1983 | Stark | |
| D273,071 | S | | 3/1984 | Stark | |
| 4,550,459 | A | | 11/1985 | Endel | |
| 4,660,239 | A | | 4/1987 | Thomas | |
| D295,936 | S | | 5/1988 | Sanders | |
| 4,949,411 | A | * | 8/1990 | Tesch | 5/636 |
| 5,038,432 | A | * | 8/1991 | Robillard et al. | 5/645 |
| D351,526 | S | | 10/1994 | Tarquinio | |
| 5,644,810 | A | * | 7/1997 | Kato | 5/645 |
| 5,809,594 | A | | 9/1998 | Isogai | |
| 5,898,963 | A | | 5/1999 | Larson | |
| 5,918,335 | A | | 7/1999 | Han | |
| D416,160 | S | | 11/1999 | Garcia | |
| D432,342 | S | | 10/2000 | Popek | |
| 6,427,268 | B1 | | 8/2002 | Davis | |
| 6,691,352 | B1 | * | 2/2004 | Wang | 5/636 |
| 6,910,237 | B1 | * | 6/2005 | DiGirolamo | 5/636 |

OTHER PUBLICATIONS www.mogu.com, 2003.

* cited by examiner

*Primary Examiner*—Michael Trettel
(74) *Attorney, Agent, or Firm*—Brooks Kushman P.C.

(57) ABSTRACT

A pillow is provided which includes a neck portion extending along a length of the pillow, and a head portion attached to the neck portion, the head portion divided into at least two head compartments. A filling material is provided within the neck and head portions. The pillow can also be embodied as a pillowcase having a first side, a second side, and an opening for receiving a pillow therein. Within at least one of the first side and second side, the pillowcase includes a neck portion extending along a length of the pillowcase, a head portion including at least two head compartments, and a filling material provided within the neck and head portions.

29 Claims, 4 Drawing Sheets

PILLOW

CROSS-REFERENCE TO RELATED APPLICATIONS

This application is a continuation-in-part of U.S. application Ser. No. 29/219,200 filed Dec. 14, 2004, now U.S. Pat. No. D523,678, which is incorporated by reference herein.

BACKGROUND OF THE INVENTION

1. Field of the Invention

The present invention relates to pillows.

2. Background Art

Nearly everyone uses a pillow when they sleep. However, typical pillows, which may be filled with materials such as down feathers, synthetic fibers or polymeric materials, may not provide adequate support to a person's head or neck. Furthermore, as a person shifts positions throughout the night, the filling materials can accumulate in the corners of the pillow leaving the user with little, if any, support.

DETAILED DESCRIPTION OF THE INVENTION

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Referring first to FIGS. 1–5, a pillow 10 according to one aspect of the present invention is illustrated. Pillow 10 may be divided into a neck portion 18 and a head portion 20. Neck portion 18 may be generally rectangular and extending the length of pillow 10. Head portion 20 may be divided into at least two head compartments, such as compartments 12, 14 and 16 shown herein. Of course, pillow 10 according to the present invention is not limited to the use of three head compartments as shown, and it is understood that more or fewer head compartments could be utilized. Neck portion 18 may be separated from the head compartments 12, 14 and 16 by any means, such as stitching, glue, or any other suitable means of forming the portions and compartments. According to one aspect of the present invention, neck portion 18 comprises between about ¼ and ⅓ of the width of pillow 10, with head portion 20 comprising the remainder of the width. However, other relative proportions of neck portion 18 and head portion 20 are fully contemplated. Furthermore, pillow 10 shown and described herein can have any length proportion, such as to form a standard size pillow, a king size pillow, or any other size.

Figure 1:
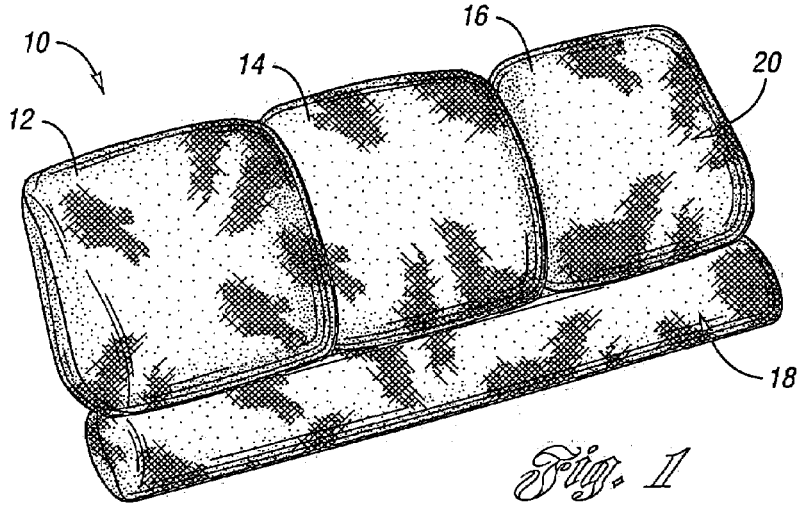
FIG. 1 is a perspective view of a pillow according to the present invention wherein the head portion is divided into three, generally equally-sized compartments.
Figure 2:
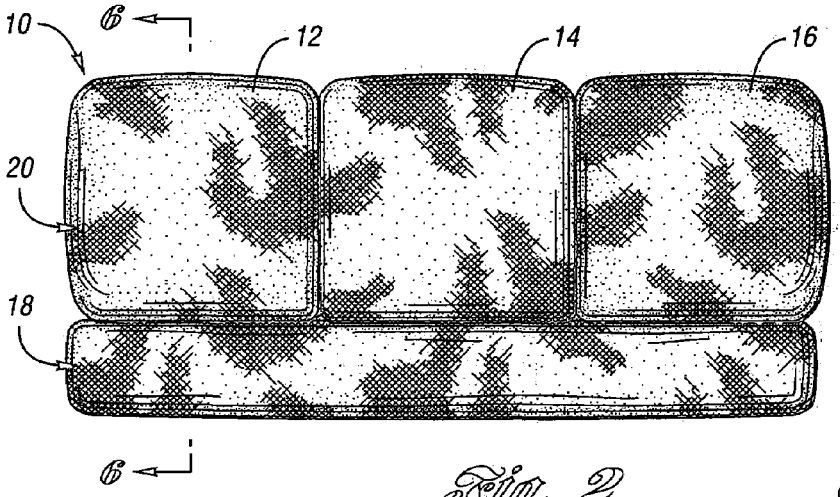
FIG. 2 is a front elevational view of the pillow of FIG. 1.
Figure 5:
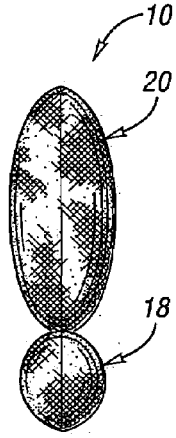
FIG. 5 is a side elevational view of the pillow of FIG. 1.
Figure 3:
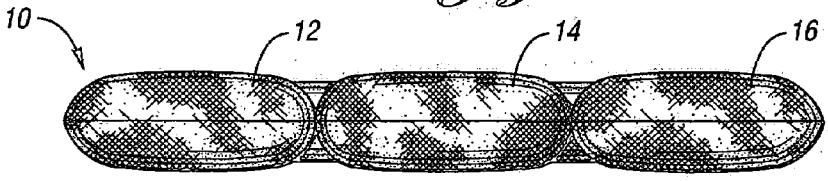
FIG. 3 is a top plan view of the pillow of FIG. 1.
Figure 4:
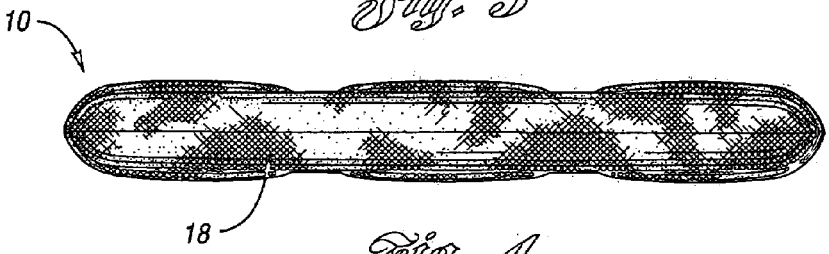
FIG. 4 is a bottom plan view of the pillow of FIG. 1.
Figure 6:
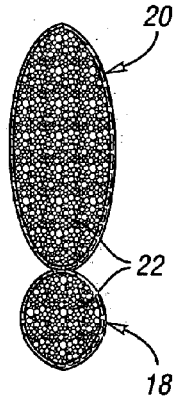
FIG. 6 is a cross-sectional view of the pillow of FIG. 1 taken along line 6—6 of FIG. 2.

Pillow 10 may be constructed from any suitable material such as, but not limited to, cotton, polyester, spandex, or other materials or combinations thereof. As illustrated in the cross-sectional view of FIG. 6, neck portion 18 and head portion 20 are filled with a filling material 22. According to one aspect of the present invention, filling material 22 includes a polymer filling, which may include polymer (such as, but not limited to, polystyrene) beads or microbeads. Of course, it is understood that filling material 22 may include any material which is suitable for filling a pillow. According to one aspect of the present invention, neck and head portions 18, 20 may provide structure to maintain filling material 22 in position underneath a user's head, rather than allowing migration of filling material 22 to the corners and edges of pillow 10.

Although not shown, a cover may be provided to enclose pillow 10. The cover may be constructed from any suitable material such as, but not limited to, cotton, polyester, spandex, or other materials or combinations thereof.

Figure 7:
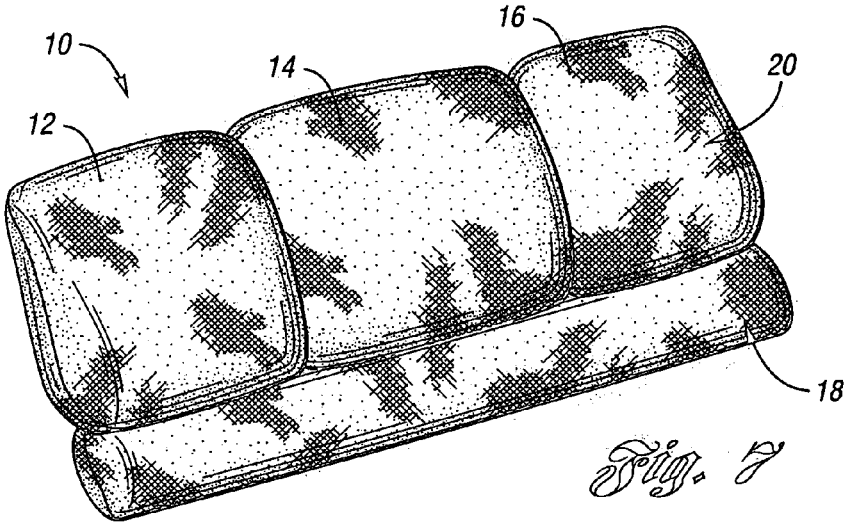
FIG. 7 is a perspective view of a pillow according to an aspect of the present invention wherein the head portion is divided into a center compartment and two generally smaller side compartments.
Figure 8:
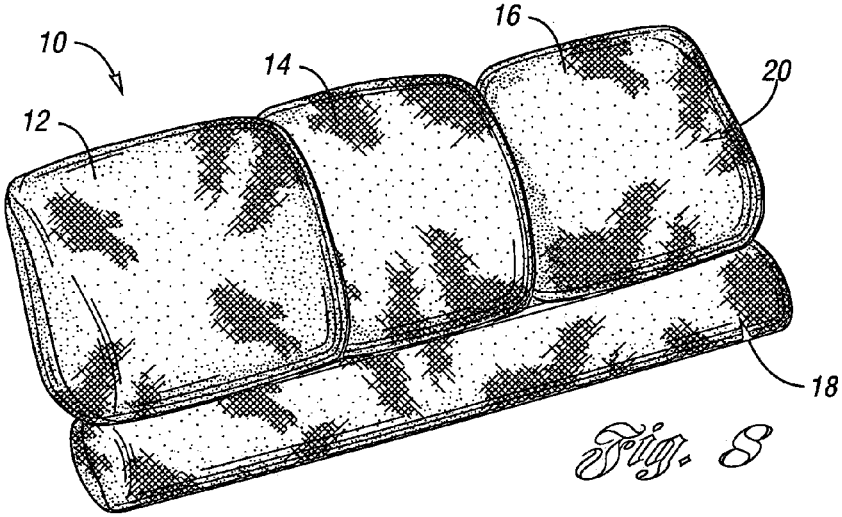
FIG. 8 is a perspective view of a pillow according to another aspect of the present invention wherein the head portion is divided into a central compartment and two generally larger side compartments.

With reference again to FIG. 1, the embodiment illustrated includes three, generally rectangular head compartments 12, 14, 16 which are disposed generally parallel to each other and are generally equally sized. According to another aspect of the present invention, center head compartment 14 could be larger than side head compartments 12 and 16 as shown in FIG. 7 or, alternatively, center head compartment 14 could be smaller than side head compartments 12 and 16 as shown in FIG. 8. The relative sizes of center head compartment 14 compared with side head compartments 12 and 16 depicted herein is merely exemplary, and other proportions of head compartments 12, 14, 16 are fully contemplated according to the present invention.

Figure 9:
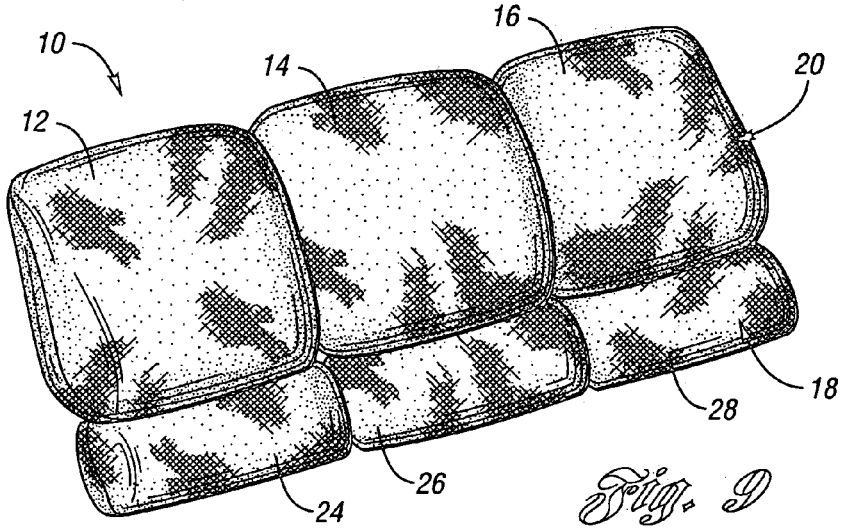
FIG. 9 is a perspective view of a pillow according to an aspect of the present invention wherein the head and neck portions are divided into three, generally equally sized compartments.

Turning to FIG. 9, a pillow 10 in accordance with another aspect of the present invention is illustrated wherein neck portion 18 is divided into at least two neck compartments, such as neck compartments 24, 26, 28 shown. FIG. 9 depicts neck compartments 24, 26, 28 which are generally equally sized, along with head compartments 12, 14, 16 which are generally equally sized. However, it is understood that neck compartments 24, 26, 28 can be utilized with pillow embodiments other than that shown in FIG. 9, and that the configuration of neck compartments 24, 26, 28 need not correspond with the configuration of head compartments 12, 14, 16 (i.e., neck compartments which are generally equally sized could be used with head compartments which are generally unequally sized).

Figure 10:
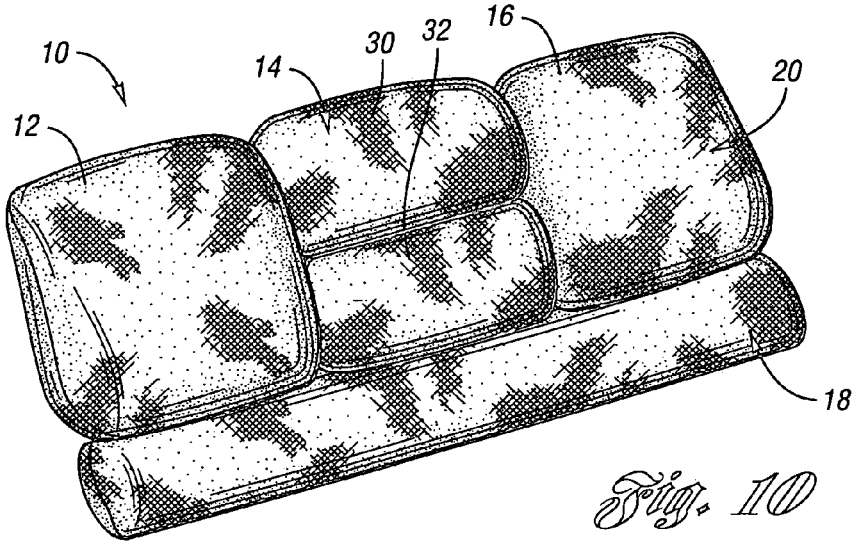
FIG. 10 is perspective view of a pillow according to another aspect of the present invention wherein the center compartment is divided into two, generally equally sized sub-compartments.
Figure 11:
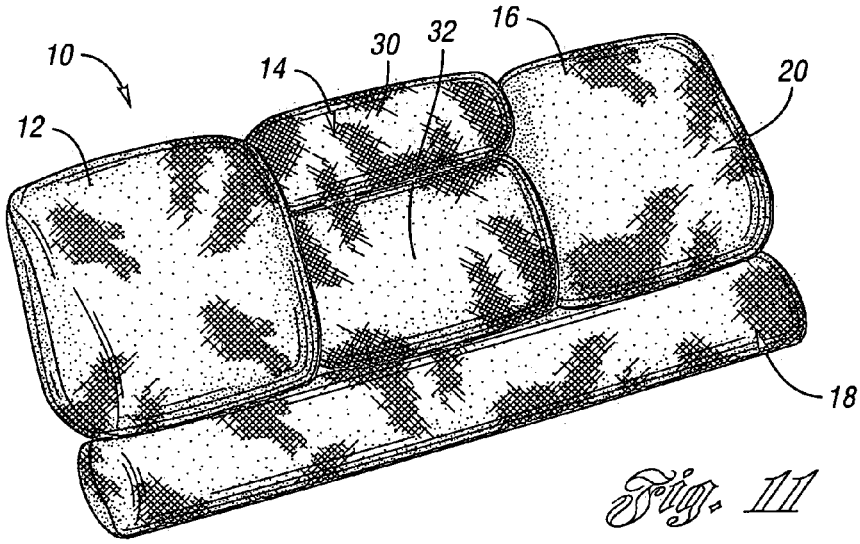
FIG. 11 is a perspective view of a pillow according to an aspect of the present invention wherein the center compartment is divided into two, generally unequally sized sub-compartments.
Figure 12:
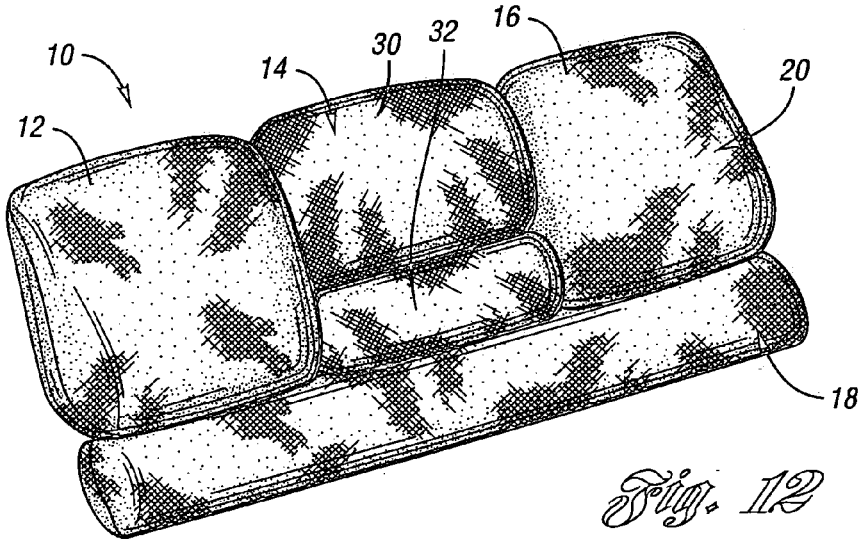
FIG. 12 is a perspective view of a pillow according to another aspect of the present invention wherein the center compartment is divided two, generally unequally sized sub-compartments.

Referring now to FIGS. 10–12, pillow 10 according to the present invention can include a center compartment 14 which is divided into two or more sub-compartments 30, 32. Sub-compartments 30, 32 can have a length dimension disposed generally parallel to the length of neck portion 18, and can be generally equally sized as depicted in FIG. 10. Alternatively, sub-compartments 30, 32 could be of differing sizes, such as a larger upper sub-compartment 30 compared with lower sub-compartment 32 (FIG. 11), or a larger lower sub-compartment 32 compared with upper sub-compartment 30 (FIG. 12). Of course, center compartment 14 could be divided into more than two sub-compartments. The sub-compartments can be disposed generally parallel to each other as illustrated herein, or could be angularly disposed. Furthermore, the sub-compartments are not limited to being disposed with their length dimension extending parallel to the length of neck portion 18 and, for example, could be disposed with their length generally perpendicular to the length of neck portion 18. Still further, side compartments 12, 16 could also be subdivided in any manner such as those configurations described above.

Figure 13:
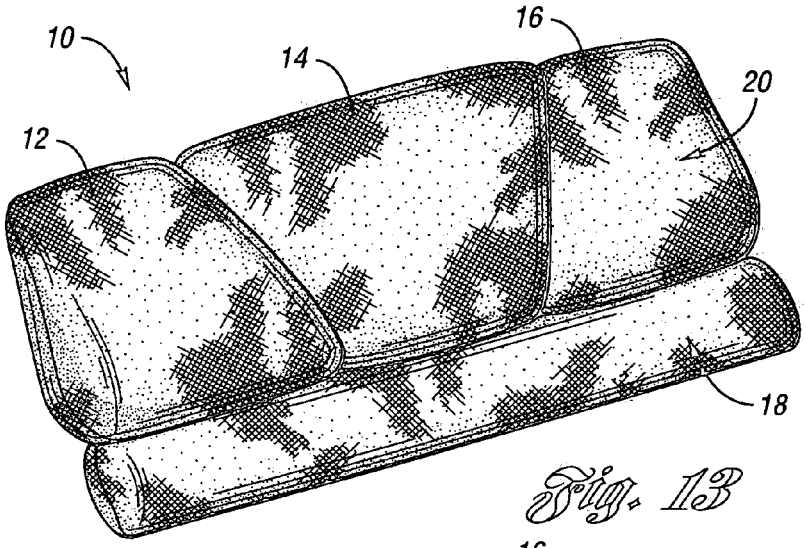
FIG. 13 is a perspective view of a pillow according to an aspect of the present invention wherein the head portion includes a generally trapezoidal center compartment.
Figure 14:
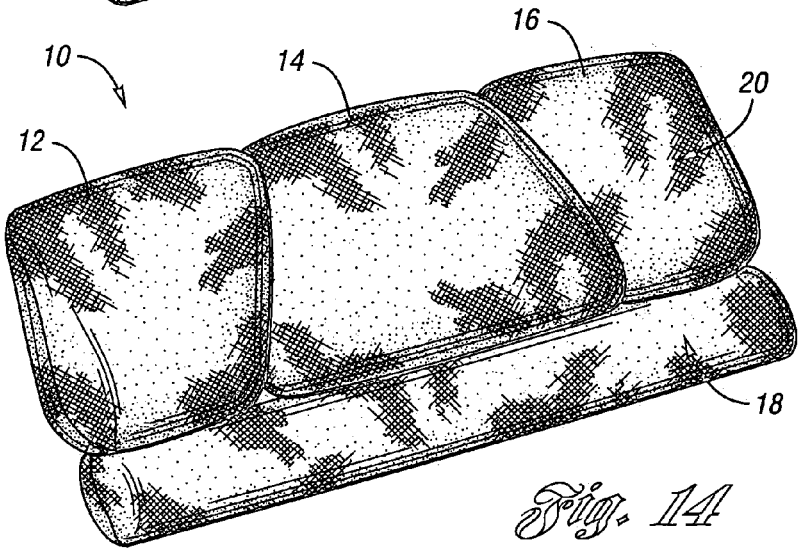
FIG. 14 is a perspective view of a pillow according to another aspect of the present invention wherein the head portion includes a generally trapezoidal center compartment.

FIGS. 13 and 14 illustrate pillows 10 according to the present invention wherein head compartments 12, 14, 16 are disposed angularly with respect to each other. As shown, center head compartment 14 can be generally trapezoidal in shape, such that center compartment 14 may be larger than side compartments 12, 16. It is understood that the particular angles, shapes, and relative sizes shown herein for the configuration of compartments 12, 14, 16 are merely exemplary, and any other angles, relative sizes, and resulting shapes of compartments 12, 14, 16 are fully contemplated according to the present invention.

Figure 16:
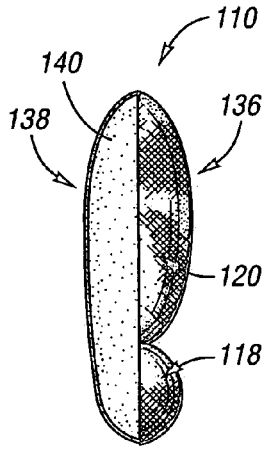
FIG. 16 is a side elevational view of a pillowcase according to one aspect of the present invention having head and neck portions on one side thereof.
Figure 15:
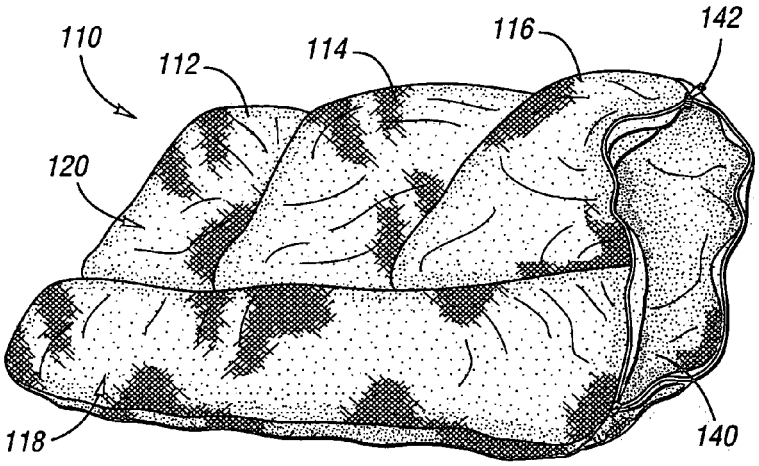
FIG. 15 is a perspective view of a pillowcase according to the present invention.
Figure 17:
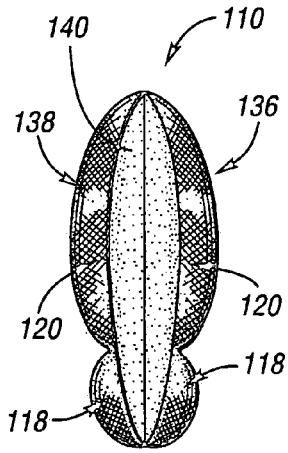
FIG. 17 is a side elevational view of a pillowcase according to another aspect of the present invention having head and neck portions on both sides thereof.

Referring now to FIG. 15, a pillowcase 110 for receiving a conventional pillow is shown, wherein those elements of pillowcase 110 corresponding to elements of pillow 10 have been designated with like reference numerals except for the addition of a "1" prefix. Pillowcase 110 has a first side 136, a second side 138 and an opening 140 therebetween for receiving a pillow therein. A zipper 142 or any other closure means such as, but not limited to, snaps, buttons, Velcro®, or the like can be provided to close opening 140 and thus secure a pillow within pillowcase 110. Neck portion 118 and head portion 120 can be provided in first side 136 alone, as depicted in FIG. 16, or neck and head portions 118, 120 can be provided in both first side 136 and second side 118 as illustrated in FIG. 17. In the embodiment depicted in FIG. 16, first side 136 may contain filling material while second side 138 may or may not contain any filling material, whereas both first and second sides 136, 138 may contain filling material in the embodiment shown in FIG. 17. Although a particular configuration of neck and head portions 118, 120 has been illustrated in FIGS. 15–17, it is understood that pillowcase 110 could also include, but is not limited to, any configuration of neck and head portions 118, 120 shown and described herein with reference to pillow 10.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A rectangular pillow, comprising:

a single, non-adjustable neck portion extending along an entire length of one long side of the pillow;

a non-adjustable head portion attached to the neck portion, the head portion divided into at least two head compartments; and a filling material provided within the neck and head portions, wherein the filling material cannot migrate between the neck and head portions or between the head compartments.

2. The pillow according to claim 1, wherein the neck portion is generally rectangularly shaped.

3. The pillow according to claim 1, wherein the at least two head compartments are generally rectangularly shaped.

4. The pillow according to claim 1, wherein the at least two head compartments are disposed generally parallel to each other.

5. The pillow according to claim 1, wherein the neck portion comprises about ¼ to ⅓ of a width of the pillow, and the head portion comprises about ⅔ to ¾ of the width of the pillow.

6. The pillow according to claim 1, wherein the head portion includes a center head compartment and two side head compartments disposed on either side of the center head compartment.

7. The pillow according to claim 6, wherein the center head compartment and the side head compartments are each of approximately equal size.

8. The pillow according to claim 6, wherein the center head compartment is larger than either of the two side head compartments.

9. The pillow according to claim 6, wherein the center head compartment is smaller than either of the two side head compartments.

10. The pillow according to claim 6, wherein the center head compartment is divided into at least two sub-compartments each having a length dimension disposed generally parallel to a length of the neck portion.

11. The pillow according to claim 10, wherein the sub-compartments are generally equally sized.

12. The pillow according to claim 10, wherein the sub-compartments are of different sizes.

13. The pillow according to claim 6, wherein the center compartment is generally trapezoidal.

14. The pillow according to claim 1, wherein the neck portion is divided into at least two neck compartments.

15. The pillow according to claim 1, wherein the filling material includes polymer beads.

16. A rectangular pillow, comprising:

a single, generally rectangular, non-adjustable neck portion extending along an entire length of one long side of the pillow;

a non-adjustable head portion attached to the neck portion, the head portion divided into three head compartments including a center compartment which is generally trapezoidal, wherein the head portion comprises about ⅔ to ¾ of a width of the pillow, and the neck portion comprises about ¼ to ⅓ of the width of the pillow; and a filling material provided within the head and neck portions, wherein the filling material cannot migrate between the neck and head portions or between the head compartments.

17. A pillowcase having a first side, a second side, and an opening for receiving a pillow therein, the pillowcase comprising:

a neck portion provided within the first side, the neck portion extending uninterrupted along an entire length of the pillowcase;

a head portion provided within the first side adjacent the neck portion, the head portion including at least two head compartments; and a filling material provided within the neck and head portions.

18. The pillowcase according to claim 17, wherein the neck portion is generally rectangularly shaped.

19. The pillowcase according to claim 17, wherein the at least two head compartments are generally rectangularly shaped.

20. The pillowcase according to claim 17, wherein the at least two head compartments are disposed generally parallel to each other.

21. The pillowcase according to claim 17, wherein the neck portion comprises about ¼ to ⅓ of a width of the pillowcase, and the head portion comprises about ⅔ to ¾ of the width of the pillowcase.

22. The pillowcase according to claim 17, wherein the head portion includes a center compartment and two side compartments disposed on either side of the center compartment.

23. The pillowcase according to claim 22, wherein the center compartment and the side compartments are each of approximately equal size.

24. The pillowcase according to claim 17, wherein the filling material includes polymer beads.

25. The pillowcase according to claim 17, further comprising closure means for closing the opening and securing a pillow within the pillowcase.

26. The pillowcase according to claim 17, wherein the second side includes a neck portion extending along a length of the pillowcase, a head portion including at least two head compartments adjacent the neck compartment, and a filling material provided within the neck and head portions.

27. The pillowcase according to claim 22, wherein the center head compartment is larger than either of the two side head compartments.

28. The pillowcase according to claim 22, wherein the center compartment is generally trapezoidal.

29. A pillow, comprising:

a non-adjustable neck portion extending along a length of the pillow;

a non-adjustable head portion attached to the neck portion, the head portion including a center head compartment and two side head compartments disposed on either side of the center head compartment, wherein the center head compartment and the side head compartments are each of approximately equal size; and a flung material provided within the neck and head portions, wherein the filling material cannot migrate between the neck and head portions or between the head compartments.

* * * * *

UNITED STATES PATENT AND TRADEMARK OFFICE

CERTIFICATE OF CORRECTION

PATENT NO. : 7,120,953 B2
APPLICATION NO. : 11/146794
DATED : October 17, 2006
INVENTOR(S) : Roman S. Ferber It is certified that error appears in the above-identified patent and that said Letters Patent is hereby corrected as shown below:

Column 6, line 32, delete “flung” and insert therefor -- filling --.

Signed and Sealed this

Tenth Day of April, 2007

JON W. DUDAS
*Director of the United States Patent and Trademark Office*